US007597320B2

(12) United States Patent
Matsumoto et al.

(10) Patent No.: US 7,597,320 B2
(45) Date of Patent: Oct. 6, 2009

(54) APPARATUS FOR PROCESSING PAPER SHEETS AND METHOD OF PROCESSING PAPER SHEETS

(75) Inventors: Yuji Matsumoto, Yokohama (JP); Yukio Asari, Yokohama (JP); Yoshihiko Naruoka, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 491 days.

(21) Appl. No.: 11/377,381

(22) Filed: Mar. 17, 2006

(65) Prior Publication Data

US 2006/0214362 A1 Sep. 28, 2006

(30) Foreign Application Priority Data

Mar. 22, 2005 (JP) ..... 2005-082006
Sep. 15, 2005 (JP) ..... 2005-268523

(51) Int. Cl.
*B65H 5/00* (2006.01)

(52) U.S. Cl. ..... 271/225; 271/184

(58) Field of Classification Search ..... 271/225, 271/902, 258.01, 65, 186, 184, 185
See application file for complete search history.

(56) References Cited

U.S. PATENT DOCUMENTS 4,486,012 A * 12/1984 Bock et al. ..... 271/3.15
4,487,506 A * 12/1984 Repp et al. ..... 399/401
5,449,166 A * 9/1995 Lohmann et al. ..... 271/225
6,419,222 B1 * 7/2002 Morrison et al. ..... 271/186
7,080,834 B2 * 7/2006 Asari ..... 271/176
2002/0070497 A1 6/2002 Morrison et al.
2004/0100017 A1 * 5/2004 Asari ..... 271/225
2005/0067765 A1 3/2005 Watanabe et al.

FOREIGN PATENT DOCUMENTS

EP 0 251 833 A1 1/1988
EP 1 295 826 A2 3/2003
EP 1 424 299 A2 6/2004
JP 2004-175507 6/2004
KR 10-2004-0066252 7/2004

OTHER PUBLICATIONS

Japanese Office Action dated Feb. 13, 2007.
European Search Report dated Oct. 18, 2007 for corresponding Application No. EP 06 00 4729.

* cited by examiner

*Primary Examiner*—Patrick H Mackey
*Assistant Examiner*—Thomas A Morrison
(74) *Attorney, Agent, or Firm*—Pillsbury Winthrop Shaw Pittman, LLP

(57) ABSTRACT

A switchback unit has a switchback roller which receives a paper sheet conveyed in a first direction into a nip for forward rotation and backwardly rotates the paper sheet after stopping the paper sheet to feed the paper sheet to a second conveyance path. When the conveyance of the paper sheet stopped on the way to the switchback section is resumed, control is performed so that the switchback roller is forwardly rotated until a sensor detects the tip of the paper sheet, and then the switchback roller is stopped and backwardly rotated.

3 Claims, 15 Drawing Sheets

Case corresponding to 1 pulse = 0.1 mm

| Medium length (mm) | Draw-in pulse number |
|---|---|
| 130 | 0 |
| 131 | 10 |
| 132 | 20 |
| 133 | 30 |
| 134 | 40 |
| 135 | 50 |
| 136 | 60 |
| 137 | 70 |
| 138 | 80 |
| 139 | 90 |
| 140 | 100 |
| 141 | 110 |
| 142 | 120 |
| 143 | 130 |
| 144 | 140 |

APPARATUS FOR PROCESSING PAPER SHEETS AND METHOD OF PROCESSING PAPER SHEETS

CROSS-REFERENCE TO RELATED APPLICATIONS

This application is based upon and claims the benefit of priority from prior Japanese Patent Applications No. 2005-082006, filed Mar. 22, 2005; and No. 2005-268523, filed Sep. 15, 2005, the entire contents of both of which are incorporated herein by reference.

BACKGROUND OF THE INVENTION

1. Field of the Invention

This invention relates to an apparatus for processing paper sheets, which has a switchback section that reverses a conveyance direction of paper, and to a method of processing paper sheets.

2. Description of the Related Art

Apparatuses for processing paper sheets are known, which comprise a switchback roller that holds a paper sheet in nip, rotates in the forward direction to convey the paper sheet forwards and rotates in the reverse direction to convey the paper sheet backwards, while keeping the sheet in nip. Such an apparatus is disclosed in, for example, Jpn. Pat. Appln. KOKAI Publication 2004-175507. In the apparatus disclosed in Publication 2004-175507, a sensor provided at a specific position detects the rear end of a paper sheet moving toward a switchback section and generates a signal. The signal is a trigger signal, which stops the switchback roller upon lapse of a given time. The switchback roller is then rotated in the reverse direction. Thus, the paper sheet can be stopped and then conveyed backwards at an appropriate time before its rear end passes the nip of the switchback roller. Therefore, any paper sheet can be switched back under the same condition, regardless of its size.

In this apparatus, a trouble such as a paper jam may occur at, for example, a pickup section or a sorting section. Upon noticing the jam, the operator stops the apparatus. In this case, the paper sheets in the apparatus are stopped, and no further paper jam will take place. The operator then removes the jamming paper sheets from the apparatus. Thereafter, the operator make the apparatus operate again. As a result, the paper sheets in the apparatus, which are not jamming, are conveyed forward again.

Assume that a paper sheet stopped on the way to the switchback section is conveyed again. The sheet may be conveyed backwards before its rear end comes sufficiently close to the nip of the roller if the sensor provided at the specific position detects the rear end of the paper sheet and the switchback roller is stopped at the above-mentioned appropriate time and the switchback roller is therefore rotated in the reverse direction. In other words, a paper sheet to be switched back cannot always be stopped at the same position if is position is managed by time while it is being accelerated during conveyance. This is because some time elapses before the speed of conveying the sheet becomes constant. If the paper sheet to be switched back is stopped at an inappropriate position, it cannot be orientated to a desired direction after it is switched back. This results in another paper jam.

Assume that a paper sheet once stopped, with its rear end already having passed the sensor provided at the specific position, may be conveyed again. Then, the paper sheet is unnecessarily fed into the switchback section because the sensor generates no trigger signals for stopping the sensor.

Consequently, the sheet is bent in the switchback section, inevitably causing a paper jam. In this case, the paper sheet will be out of sight because the operator cannot see the interior of the switchback section.

BRIEF SUMMARY OF THE INVENTION

An object of this invention to provide an apparatus for processing paper sheets and a method for processing paper sheets, in which any paper sheet stopped at a position until any other jamming paper is removed can be processed, without causing a jam. To achieve the object, an apparatus for processing paper sheets, according to this invention, comprises: a switchback section which receives and stops a paper sheet fed in a first direction and feeds the paper sheet in a second direction opposite to the first direction; a first conveyance path through which the paper sheet is fed in the first direction into the switchback section; a second conveyance path through which the paper sheet is fed in the second direction from the switchback section; a detection section which detects that a rear end of the paper sheet moving in the first direction has reached a position where the rear end can be oriented to the second conveyance path; a control section which causes the switchback section to convey the paper sheet in the first direction until the detection section detects that the rear end of the paper sheet has reached the position and causes the switchback section to start conveying the paper sheet in the second direction when the detection section detects that the rear end of the paper sheet has reached the position, in order to convey the paper sheet again after having been stopped before reaching the switchback section.

When any paper sheet being conveyed is stopped due to, for example, a paper jam, and is conveyed again after the jam is eliminated, the detection section detects the paper sheet, thus preventing a paper jam in the switchback section. That is, when the paper sheet is stopped for some reason, the switchback section is controlled to feed the paper sheet in the second direction if the detection section has detected the paper sheet. Assume the detection section does not detected the paper sheet when the sheet is conveyed again, the switchback section is controlled to keep conveying the paper sheet in the first direction until the detection section detects the paper sheet. When the sheet is detected, it is conveyed in the second direction. Hence, the paper sheet is prevented from jamming in the switchback section when it is conveyed again.

Another apparatus for processing paper sheets, according to this invention, comprises: a switchback roller which has a nip and rotates in a first direction to hold a paper sheet in nip and then to convey into a switchback section, and rotates in a second direction opposite to the first direction to convey the paper sheet in the second direction, while holding the paper sheet in the nip; a first conveyance path through which the paper sheet is conveyed in the first direction into the nip of the switchback roller; a second conveyance path through which the paper sheet is conveyed in the second direction from the nip of the switchback roller; a sensor which detects that a rear end of the paper sheet moving in the first direction into the switchback section has reached a position where the rear end can be oriented to the second conveyance path; and a control section which causes the switchback roller to rotate in the first direction when the sensor does not detects that the rear end of the paper sheet has reached the position and causes the switchback roller to start rotating in the second direction when the detection section detects that the rear end of the paper sheet has reached the position, in order to convey the paper sheet again after having been stopped before reaching the switchback section.

A method of processing paper sheets, according to this invention, comprises: feeding a paper sheet in first direction through a first conveyance path into a switchback section, stopping the paper sheet temporarily, and feeding the paper sheet from the switchback section through a second conveyance path in a second direction opposite to the first direction; controlling the switchback section so that the paper sheet is fed in the first direction into the switchback section until the rear end of the paper sheet reaches a position where the rear end can be oriented to the second conveyance path, in order to convey the paper sheet again after having been stopped before reaching the switchback section; and controlling the switchback section so that the paper sheet is fed in the second direction after the rear end of the paper sheet reaches the position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of this invention will be described in detail, with reference to the drawings.

Figure 1:
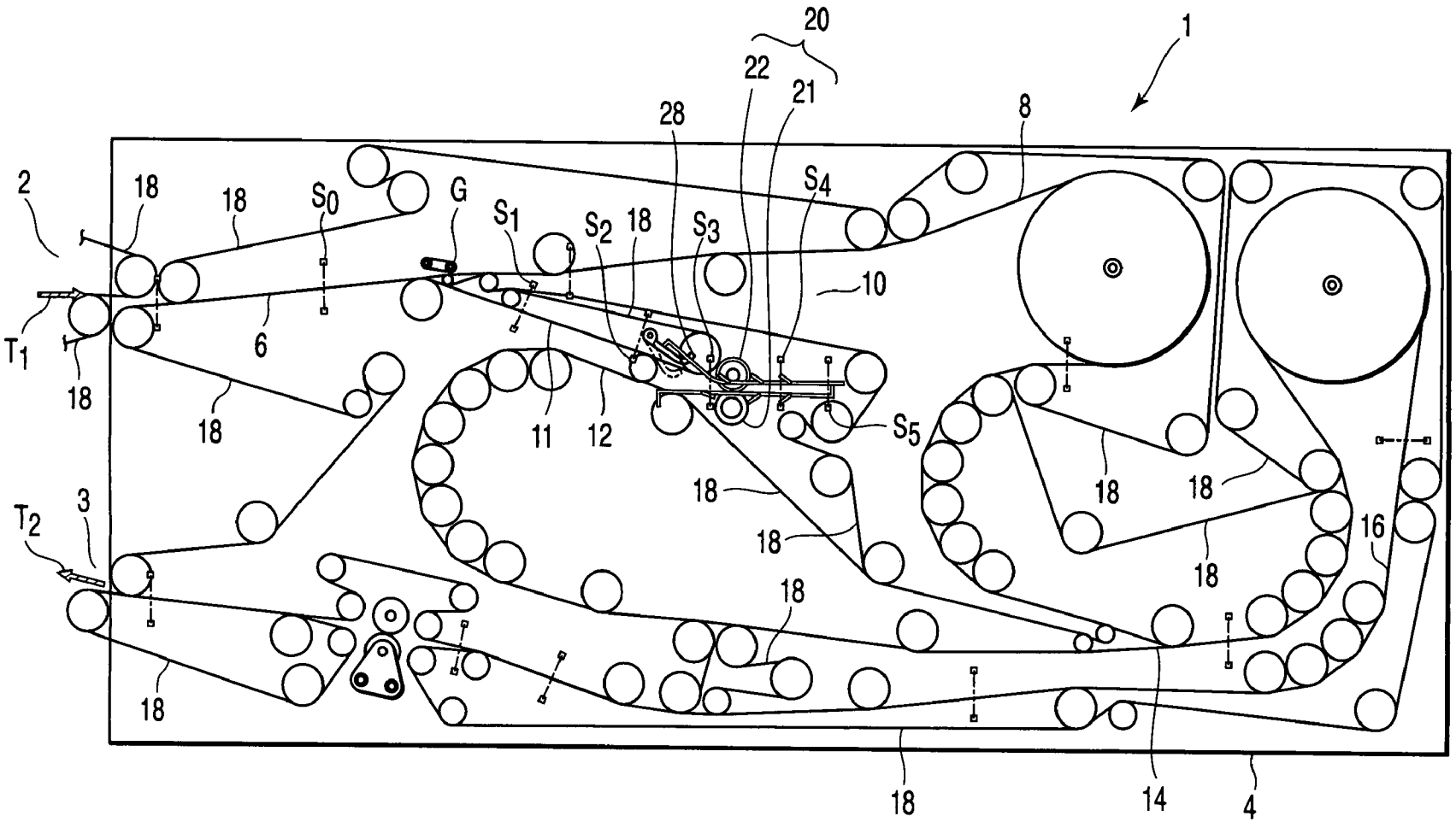
FIG. 1 is a schematic diagram showing the internal structure of a switchback unit incorporated in a paper sheet processing apparatus according to an embodiment of this invention.

FIG. 1 shows a schematic structure of the switchback unit 1 incorporated in an apparatus for processing paper sheets, which is an embodiment of this invention. The apparatus has, in addition to this switchback unit 1, many mechanisms (not shown), such as a pickup section which picks up a plurality of sheets of paper sheet one by one onto a conveyance path, an inspection section which inspects the paper sheet conveyed via the conveyance path, a branch gate which separates the inspected paper sheet on the basis of inspection results thereof, a sort/accumulation section which sorts/accumulates the paper sheet into designated sort destinations, and a control section which controls the operation of these sections.

As shown in FIG. 1, the switchback unit 1 has a case 4. The case includes, in a left wall, a receiving slot 2 which receives the paper sheet conveyed in an arrow T1 direction in the drawing, and a feed slot 3 which feeds the processed paper sheet in an arrow T2 direction in the drawing. A conveyance path 6 extends from the receiving slot 2 in the case 4. In the path 6, a gate G is provided. The gate G guides a paper sheet to either a switchback section 10 or a straight path 8.

A branch conveyance path 11, which extends toward the switchback section 10 downstream of the gate G, functions as first conveyance path 11. A conveyance path 12, located downstream of the switchback section 10, functions as second conveyance path 12. A terminal end of the second conveyance path 12 joins a terminal end of the above-mentioned straight path 8 at a joining portion 14.

The straight path 8 is as long as the length of the first conveyance path 11, the second conveyance path 12 and a conveyance path passing the switchback section 10. Hence, conveyance time of the paper sheet to reach the joining portion 14 after passing the gate G may be the same. Moreover, a conveyance path 16 located downstream of the joining portion 14 extends to the feed slot 3.

A plurality of sensors is provided on the conveyance paths of the paper sheet. Sensors S0 to S5 are provided on the conveyance path that extends from the receiving slot 2 to the switchback section 10. The sensors S0 to S5 have a light emitter and a light receiver each. Each sensor has an optical axes traversing the conveyance path. When a paper sheet blocks the optical axis of any sensor, the sensor detects the passage of the paper sheet. Both sides of the conveyance path extending in the case 4 are defined by a plurality of endless conveyance belts 18 (see FIG. 3). A paper sheet is conveyed through the conveyance paths, while being held between these conveyance belts 18.

Figure 2:
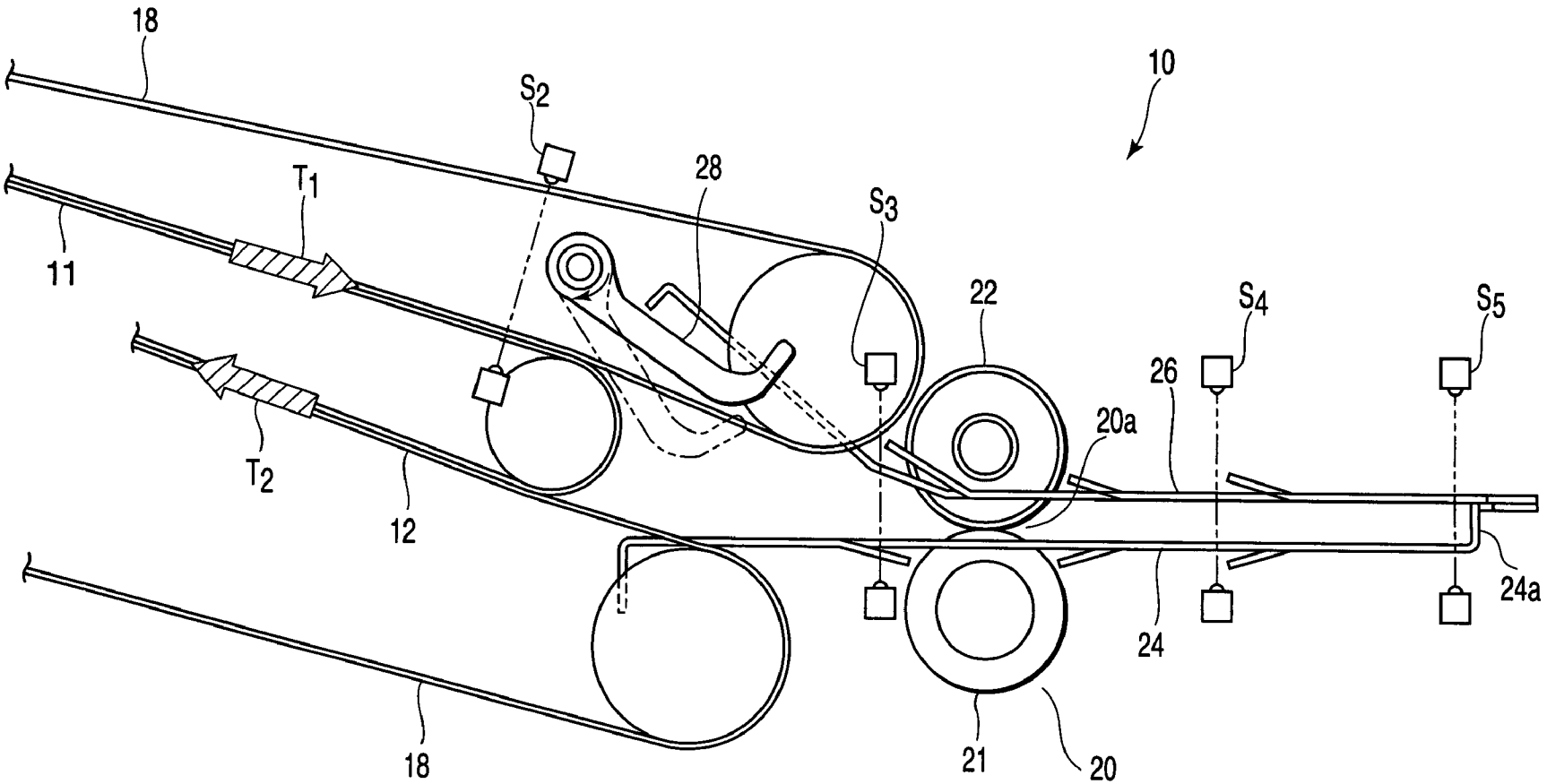
FIG. 2 is a partial enlarged view illustrating the structure of essential parts of the switchback unit of FIG. 1 partially in an enlarged form.

FIG. 2 shows a partial enlarged view showing the switchback unit 10 and the members provided near the unit 10.

The switchback section 10 has a switchback roller 20 constituted of a pair of rubber rollers, i.e., drive roller 21 and a driven roller 22. The drive roller 21 is positioned below the driven roller 22, and the conveyance path 11 passes between the rollers 21 and 22. The rollers 21 and 22 contact one the other, forming a nip 20*a*. They receive, into the nip 20*a*, the tip of the paper sheet being conveyed in the direction of arrow T1 (first direction) through the first conveyance path 11.

Figure 3:
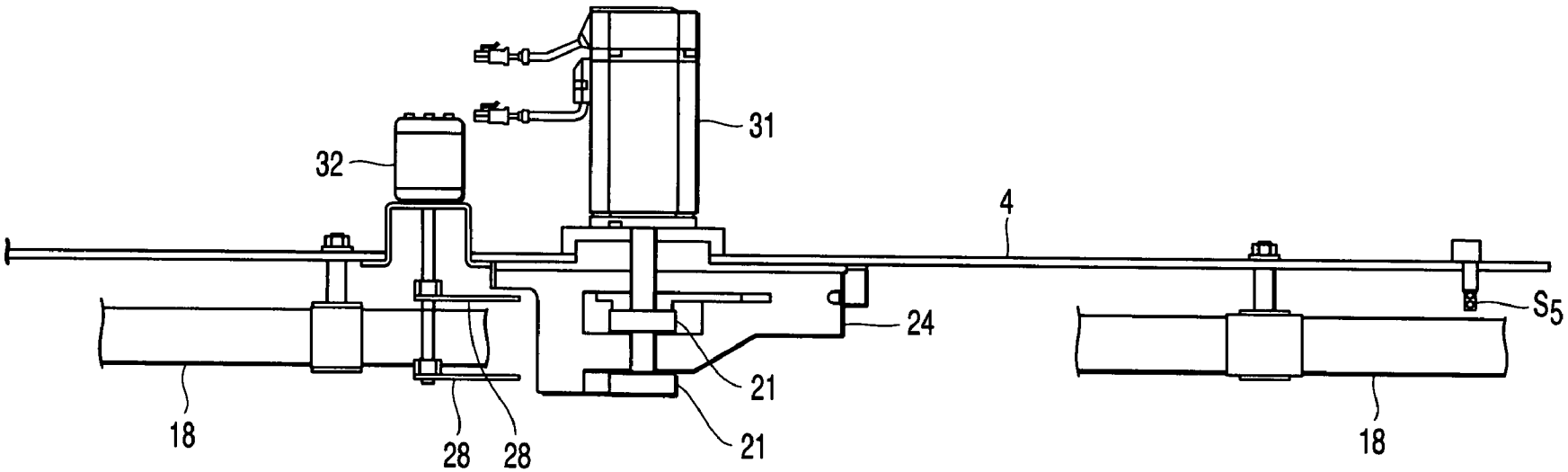
FIG. 3 is a diagram depicting the structure of the essential parts of FIG. 2, as viewed from the drive roller.

As FIG. 3 shows, an AC servomotor.31 can drive the drive roller 21 in both forward and backward directions. The drive roller 21 rotates forwards (in first direction), or in clockwise direction (CW direction) in FIG. 2, or rotates backwards (in second direction), or in counterclockwise direction (CCW direction) in FIG. 2. The driven roller 22 comprises a cylindrical sponge core and a rubber member covering the outer periphery of the sponge core. The driven roller 22 is pressed against the drive roller 21 and elastically deformed. It is rotated as the drive roller 21 rotates.

The switchback section 10 further has a stopper 24*a*. The stopper 24*a* stops the tip of the paper sheet moving in the direction of arrow T1 and guides the tip of the paper into the nip 20*a* of the switchback roller 20. The stopper 24*a* has been formed by upwardly bending the right end of a lower guide plate 24, which defines a lower surface side in the drawing of the paper sheet fed into the switchback section 10. An upper guide plate 26 is positioned to contact the upper surface of any paper sheet fed into the switchback section 10.

The switchback section 10 has a kick lever 28 (orientation member), too. The lever 28 beats the rear end of a paper sheet downwards, as the sheet is moves in the first direction and held in the nip 20*a*, orientating the rear end of the sheet to the second conveyance path 12. The kick lever 28 is operated by a rotary solenoid 32 as shown in FIG. 3. When operated, the kick lever 28 pivots between a non-operation position indicated and an operation position, which are indicated by a solid line a dotted line in FIG. 2. In the operation position, the kick lever 28 can beat the rear end of the paper sheet, orientating the rear end to the second conveyance path 12.

Note that the above-mentioned sensor S0 (only shown in FIG. 1) detects the passage of the paper sheet traveling from the receiving slot 2 to the gate G, and obtains switch timing of the gate G. The sensor S1 functions as a length sensor. It detects the dimension that sheet has in the conveyance direction, not only from the speed of conveying the sheet, but also from the time that elapses from the detection of the tip of the paper sheet to the detection of the rear end thereof.

The sensor S2 shown in FIG. 2 is located upstream of the kick lever 28 with respect to the first direction. The sensor S2 detects the rear end of the paper sheet being conveyed in the first direction, to order to stop the switchback roller 20 at an appropriate time. That is, the switchback roller 20 is stopped upon lapse of a given time from the moment the sensor S2 detects the passage of the rear end of the paper sheet. When the roller 20 is so stopped, the paper sheet is stopped, held in the nip 20*a*. That is, the switchback roller 20 is stopped by a trigger signal that the sensor 2 generates upon detecting the rear end of the sheet, thus stopping the sheet at such a position where the kick lever 28 can beat the rear end, orientating the same to the second conveyance path 12.

The sensor S3 detects whether the paper sheet exists immediately before the nip 20*a* of the switchback roller 20 as viewed in the first direction. The sensor S4 detects whether the paper sheet exists immediately after the nip 20*a*, as viewed in the first direction.

The sensor S5 detects the arrival of the tip of the paper sheet moving in the first detection, at a point near the stopper 24*a* that is located at a terminal end of the switchback section 10. That is, the sensor S5 functions as a detection section that that the rear end of the paper sheet moving in the first direction and received in the switchback section 10 can be oriented to the second conveyance path 12.

Figure 4:
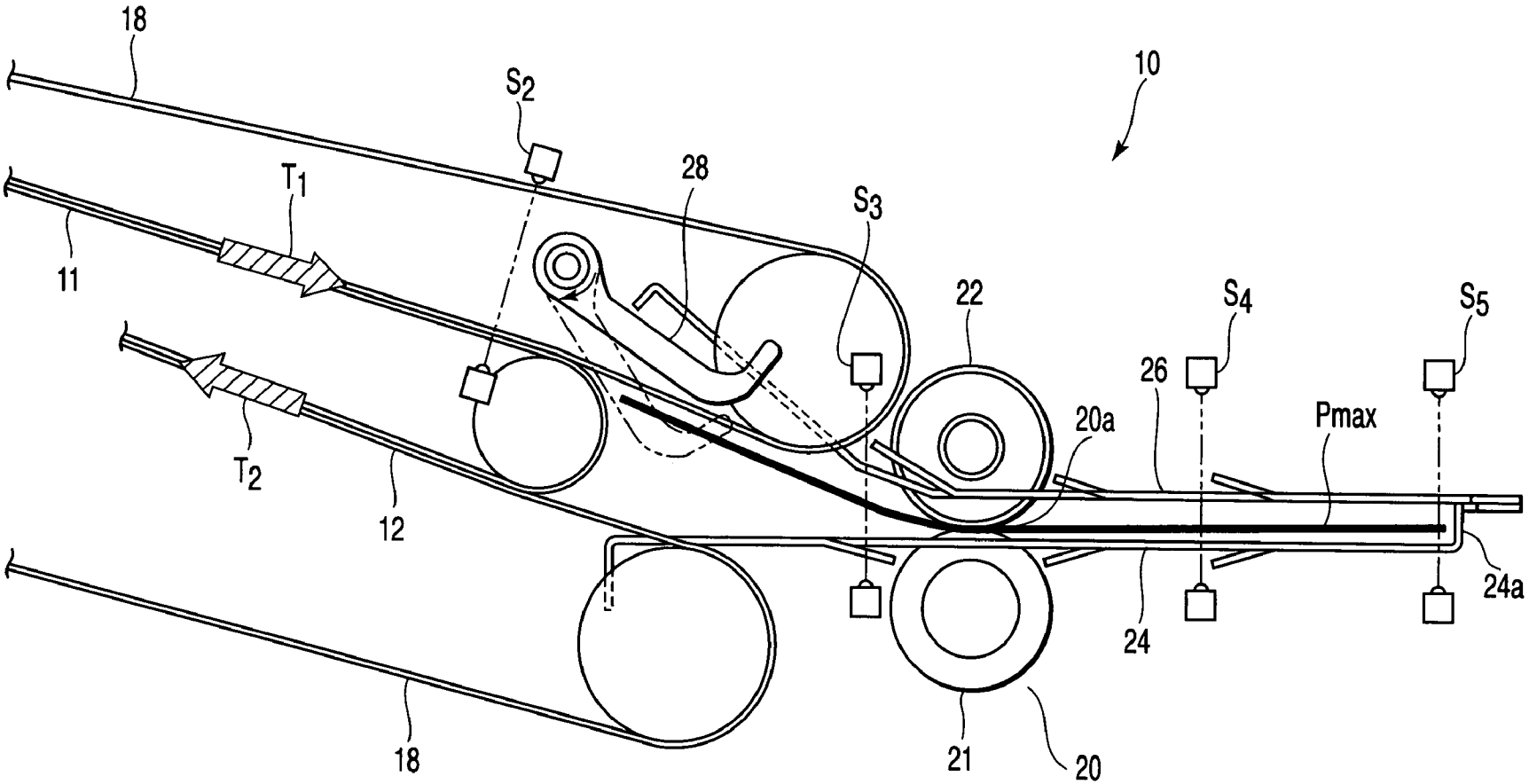
FIG. 4 is a diagram showing the state of the tip of the largest paper sheet detected by the sensor S5.

Assume that, as shown in FIG. 4, the sensor S5 may detect the tip of the largest paper sheet Pmax moving in the first direction and being longer in the first direction than any other paper sheet that can be processed by the apparatus. The rear end of the largest paper sheet Pmax is out of the first conveyance path 11 and can be oriented to the second conveyance path 12. Any paper sheet in this state can be orientated to the second conveyance path 12 if the kick lever 28 beats its rear end. Any paper sheet not in this state cannot be orientated to the second conveyance path 12 even if the kick lever 28 beats its rear end.

Figure 5:
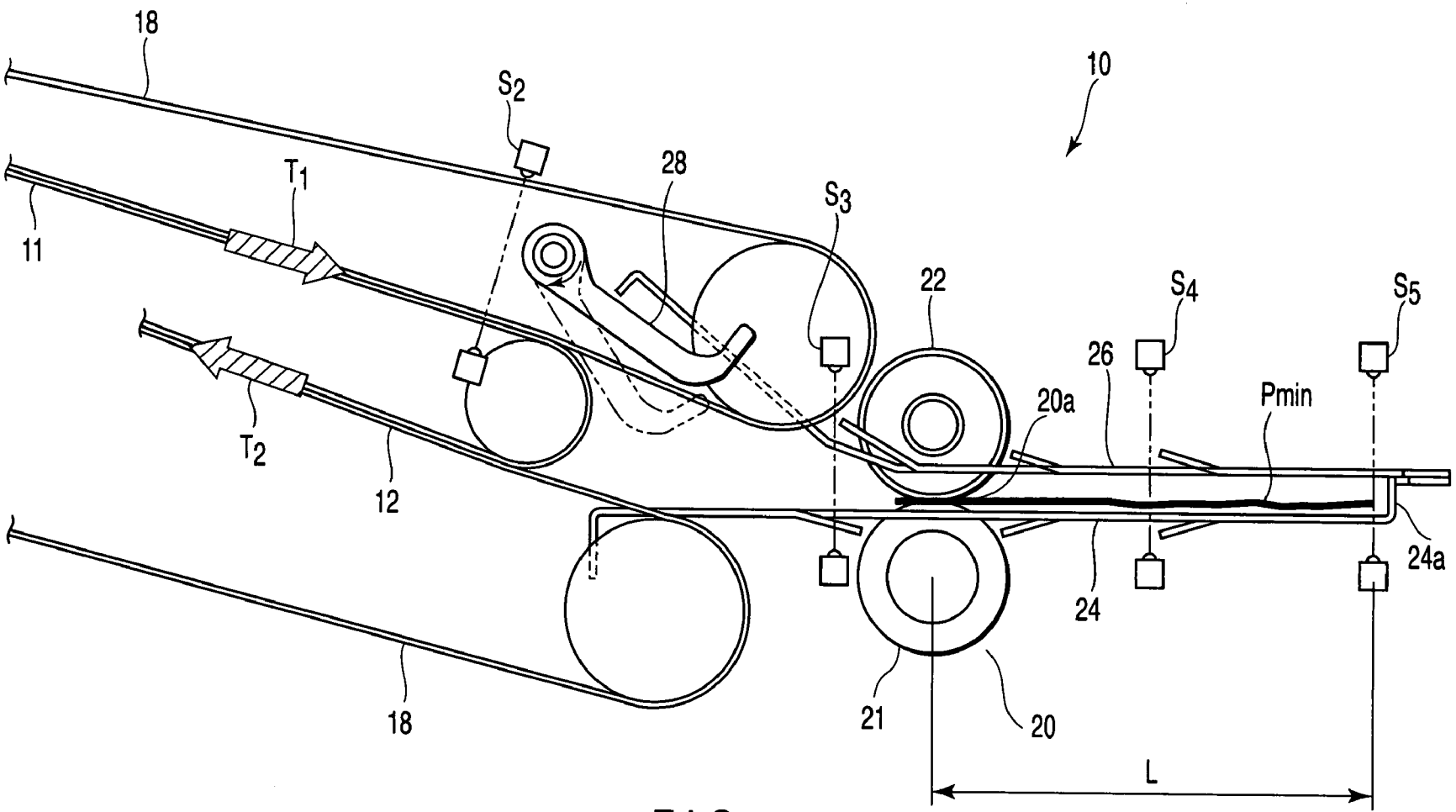
FIG. 5 is a diagram showing the state of a tip of smallest paper sheet detected by the sensor S5.

Assume that, as shown in FIG. 5, the sensor S5 may detect the tip of the smallest paper sheet Pmin moving in the first direction and being shorter than in the first direction than any other paper sheet that can be processed by the apparatus. The rear end of the smallest paper sheet Pmin is out of the first conveyance path 11, too, and can be oriented to the second conveyance path 12. That is, any paper sheet having its rear end detected by the sensor S5 can be oriented to second conveyance path 12, regardless of its length measured in the conveyance direction.

In the present embodiment, the stopper 24*a* is located at such a position that the largest paper sheet Pmax is stopped, with its tip bumps against the stopper 24*a*, at a position where its rear end of this sheet Pmax is out of the first conveyance path 11 and can therefore be oriented to the second conveyance path 12.

Furthermore, as shown in FIG. 5, a distance L between the nip 20*a* of the switchback roller 20 and the paper sheet detected by the sensor S5 is shorter than the length of the smallest paper sheet Pmin as measured in the conveyance direction. In other words, the length L is of such a value that the rear end of the smallest paper sheet Pmin moving in the first direction does not depart from the nip 20*a* of the switchback roller 20 when the sensor S5 detects the tip of smallest paper sheet Pmin. To put it differently, at the position detected by the sensor S5, the tip of any paper sheet is held in the nip, regardless of its length as measured in the first direction.

Figure 12:
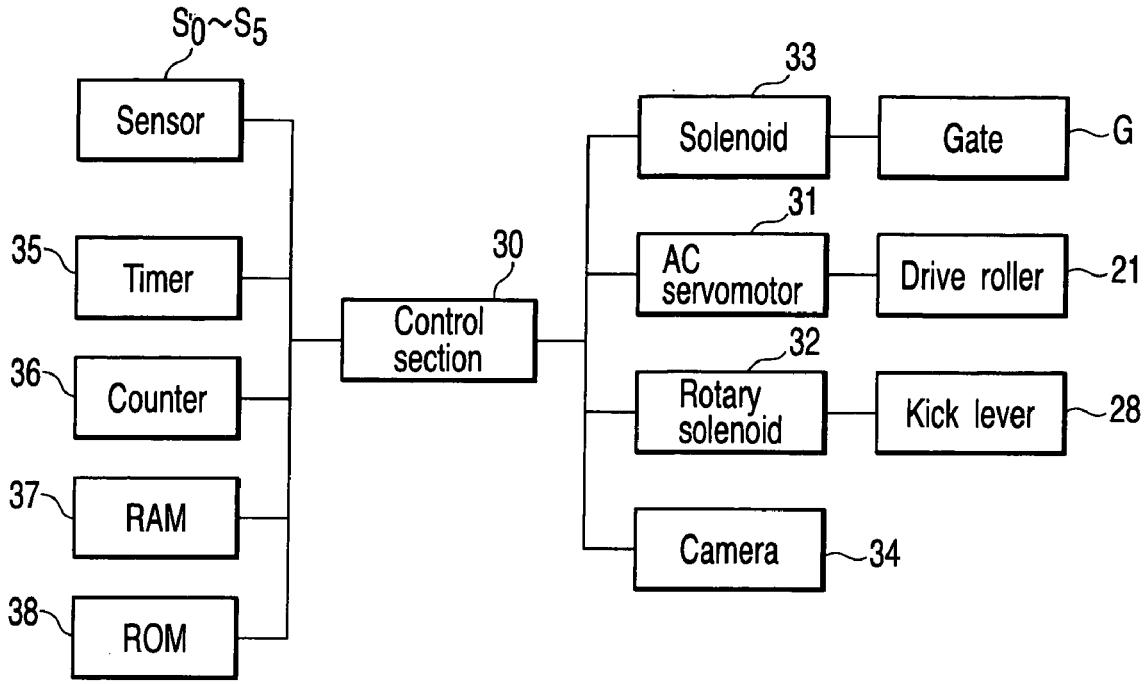
FIG. 12 is a block diagram of a control system that controls the switchback unit shown in FIG. 1.

FIG. 12 is a block diagram of a control system that controls the switchback unit 1 described above.

The above-mentioned six sensors S0 to S5 are connected to a control section 30 that controls the switchback unit 1. To the control section 30, there are connected the AC servomotor 31 that rotates the drive roller 21 of the switchback roller 20 in both the forward and backward directions, and the rotary solenoid 32 that operates the kick lever 28 between the above-mentioned two positions. Also connected to the control section 30 are a solenoid 33 that switches the gate G, a camera 34 that capture images of the paper sheet located in the vicinity of the kick lever 28, a timer 35 that counts control time of each mechanical section, and a counter 36 which counts a drive pulse number of various motors. Also connected to the control section 30 are a RAM 37 that retains various kinds of data and a ROM 38 that stores a control program and the like.

Figure 6:
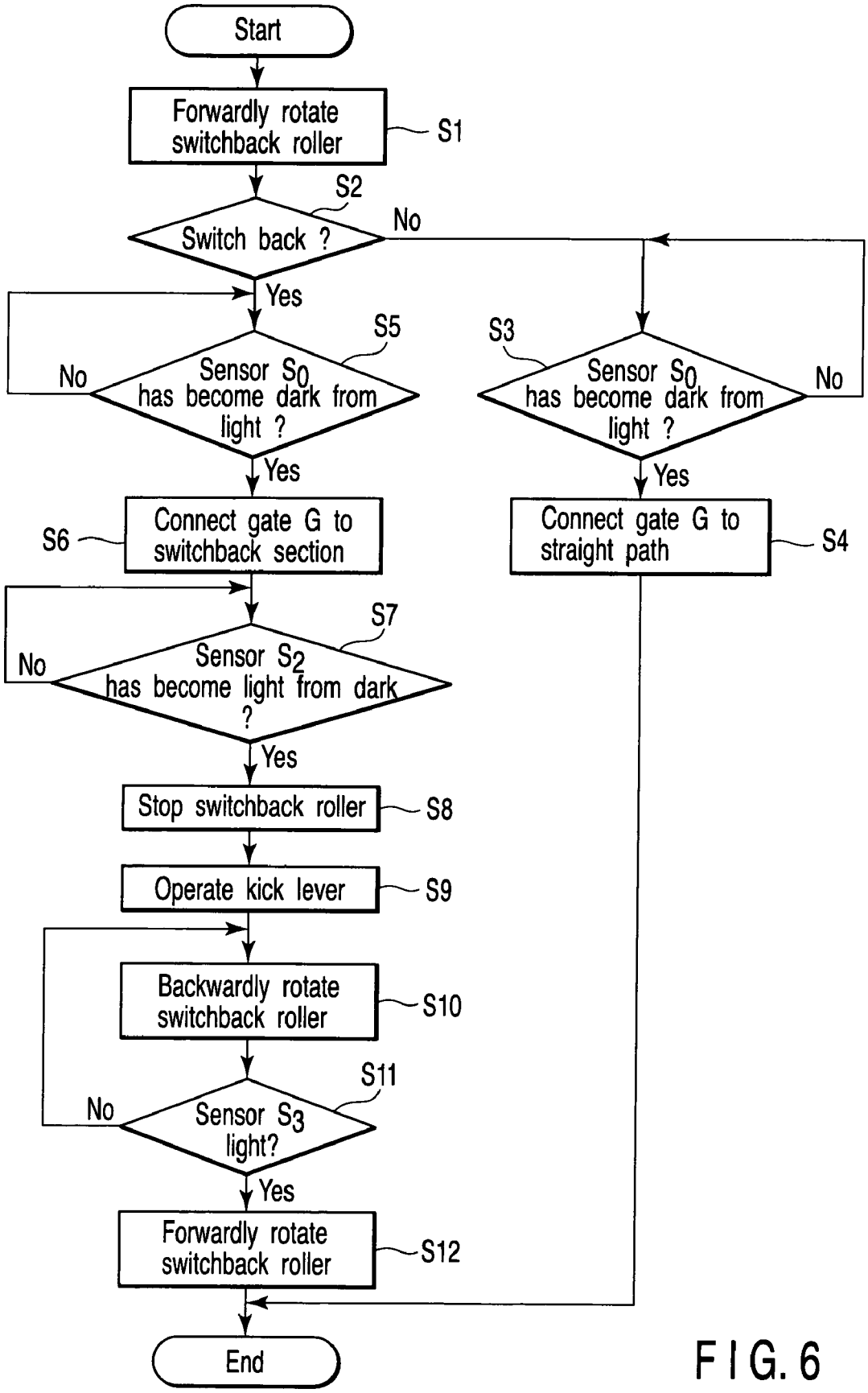
FIG. 6 is a flowchart explaining an operation performed by the switchback unit shown in FIG. 1.

How the switchback unit 1 so structured as descried above operates will be explained, with reference to a flowchart shown in FIG. 6.

While the switchback unit 1 remains in the standby state, the control section 30 rotates the switchback roller 20 in the first direction (step 1). The control section 30 then determines whether the paper sheet fed into the switchback unit 1 is one that should be switched back, from the detection results of the detection section (not shown) (step 2).

If it is determined that the paper sheet fed into the switchback unit 1 is one that need not be switched back (NO in step 2), the control section 30 monitors an output signal of the sensor S0 located upstream of the gate G in the conveyance direction, determining whether that the output of the sensor S0 has become dark from light (step 3). If YES in step 3, the control section 30 connects the gate G to the straight path 8 (step 4).

If it is determined that the paper sheet fed into the switchback unit 1 is one that need to be switched back (YES in step 2), the control section 30 monitors the output of the sensor S0, determining whether that the output of the sensor S0 has become dark from light (step 5). If YES in step 5, the control section 30 connects the gate G to the straight path 10 (step 6).

Subsequently, the control section 30 monitors the output of the sensor S2 located near the kick lever 28, determining whether the output of the sensor S2 has become light from dark (step 7). If YES in step 7, the control section 30 stops the switchback roller 20 upon lapse of a prescribed time (step 8).

The control section 30 then turns the kick lever 28 from the non-operation position to the operation position (step 9). So turned, the kick lever 28 orients the rear end of the paper sheet stopped, to the second conveyance path 12.

Thereafter, the control section 30 rotates the switchback roller 20 backwards (step 10) to feed the paper sheet to the second conveyance path 12. The section 30 determines whether the output of the sensor S3 has become light as a trigger (step 11). If YES in step 11, the control section 30 rotates the switchback roller 20 forwards (step 12).

In the paper sheet processing apparatus comprising the switchback unit 1, a plurality of paper sheets are picked up one after another, with a fixed gap or at a fixed pitch, and are conveyed onto the conveyance path. They are sorted or accumulated to and at the sort destinations designated, after they are subjected to necessary processing. Therefore, when a paper jam occurs at some place in the apparatus, the apparatus is immediately stopped, interrupting the conveyance of any papers in the apparatus. The operator removes the paper sheet or sheets that have caused the jam. If the operator does not stop the apparatus and the apparatus keeps operating, other paper jams will take place. This is why the operation should stop the apparatus upon, finding a paper jam and then remove all papers causing the jam before he or she starts the apparatus again.

After the jam has been eliminated, however, various troubles may develop when the apparatus is started again, if a paper sheet stops on the conveyance path before reaching the switchback section 10.

Figure 7:
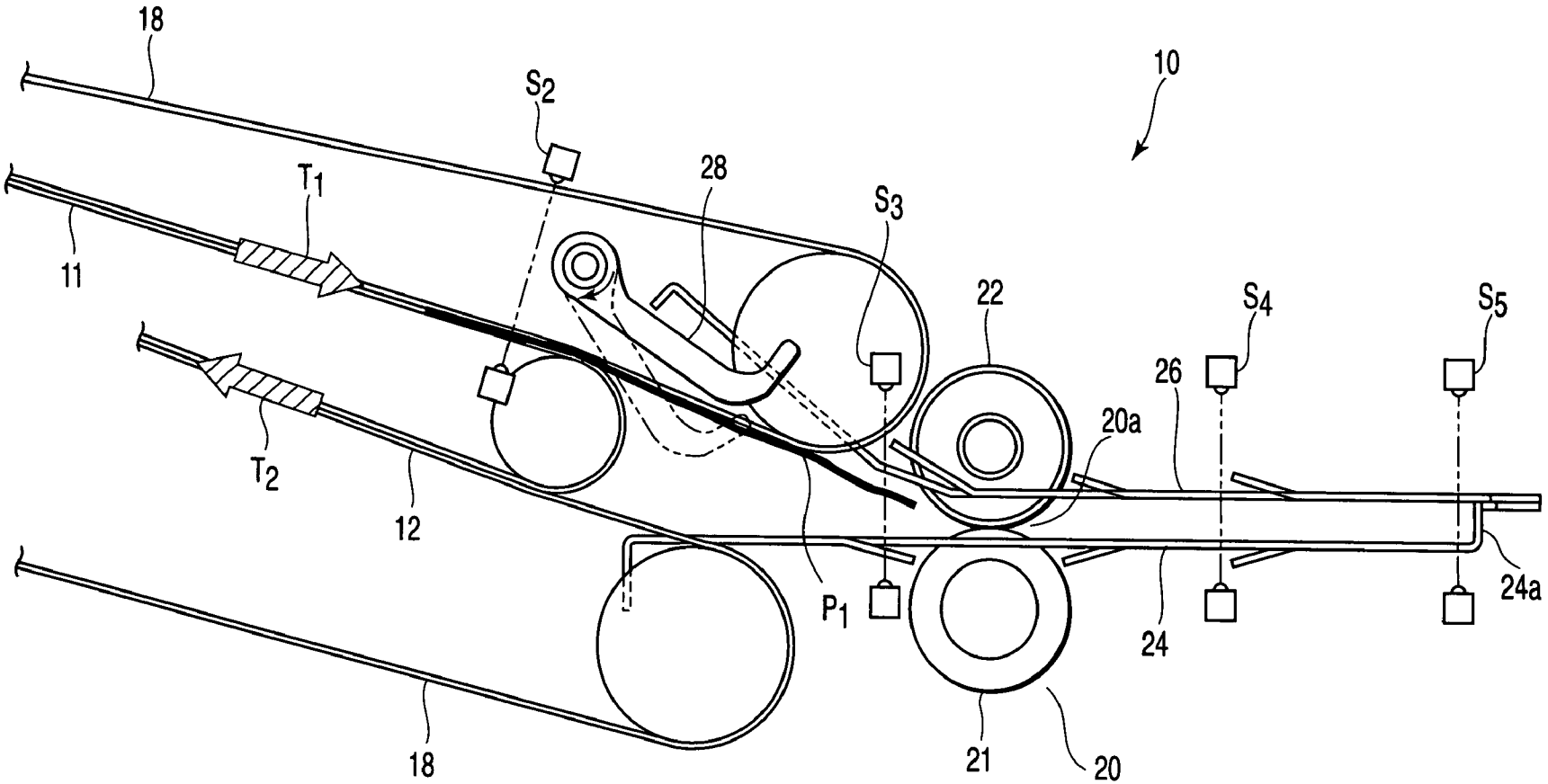
FIG. 7 is a diagram showing the paper sheet, whose rear end has not passed a sensor S2 when the stopped conveyance of the paper sheet is resumed.

For example, a rear end of paper sheet P1 moving in the first direction may be stopped with its rear end blocking the optical axis of the sensor S2 as shown in FIG. 7 after a paper jam has been eliminated. In this case, when the sensor S2 detects the rear end of the paper sheet P1, if the switchback roller 20 is stopped in steps 7 and 8 (FIG. 6) after the conveyance of the paper sheet P1 is resumed, the paper sheet P1 may be stopped before the rear end of the paper sheet P1 comes sufficiently close to the nip 20*a*. That is, to convey the paper sheet again, time for acceleration is needed before the conveyance speed of the paper sheet is stabilized. Since the conveyance speed of the paper sheet is low during the acceleration operation, the paper sheet will be stopped before an expected conveyance position.

If this happens, the rear end of the paper sheet P1 moving in the first direction cannot escape from the first conveyance path 11, and the rear end cannot be oriented to the second conveyance path 12 even if the kick lever 28 is operated. If the position where the rear end of the paper sheet P1 exists when the sheet moving in the first direction is stopped changes, the paper sheet P1 will causes a jam in the worst case.

Figure 8:
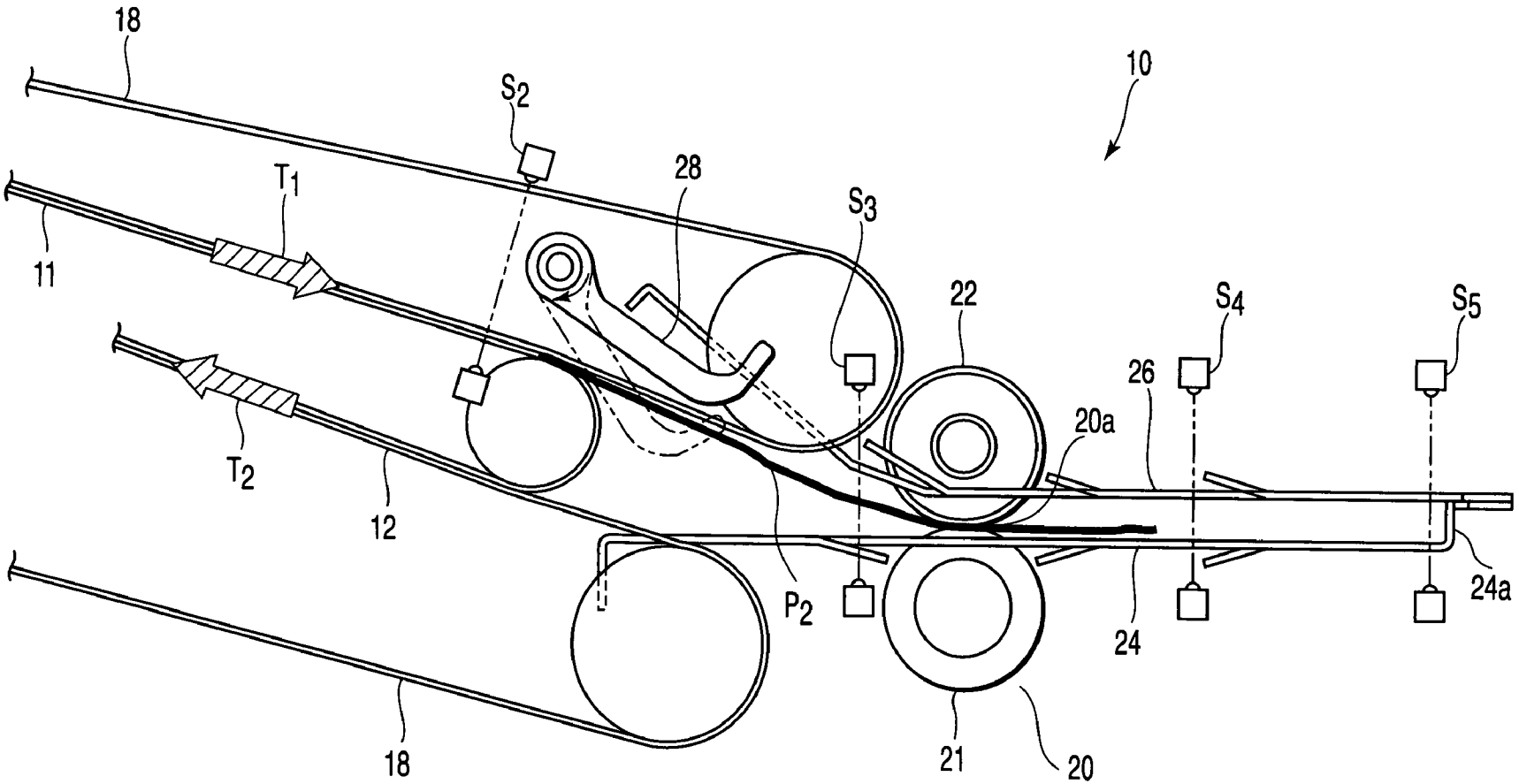
FIG. 8 is a diagram showing the paper sheet, whose rear end has passed the sensor S2 when the stopped conveyance of the paper sheet is resumed.
Figure 9:
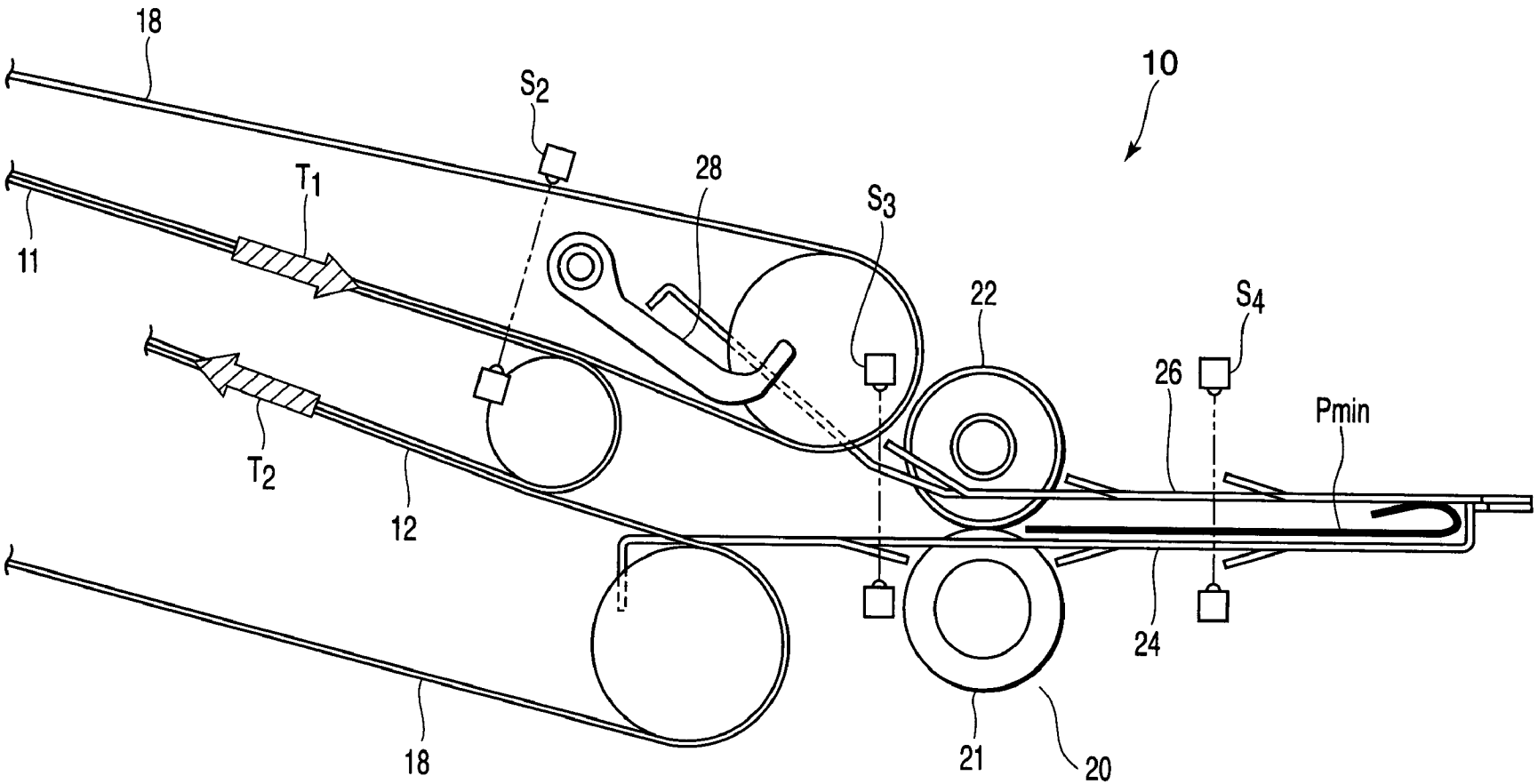
FIG. 9 is a diagram showing a state that the smallest paper sheet may assume when it is conveyed again from the state shown in FIG. 8.
Figure 10:
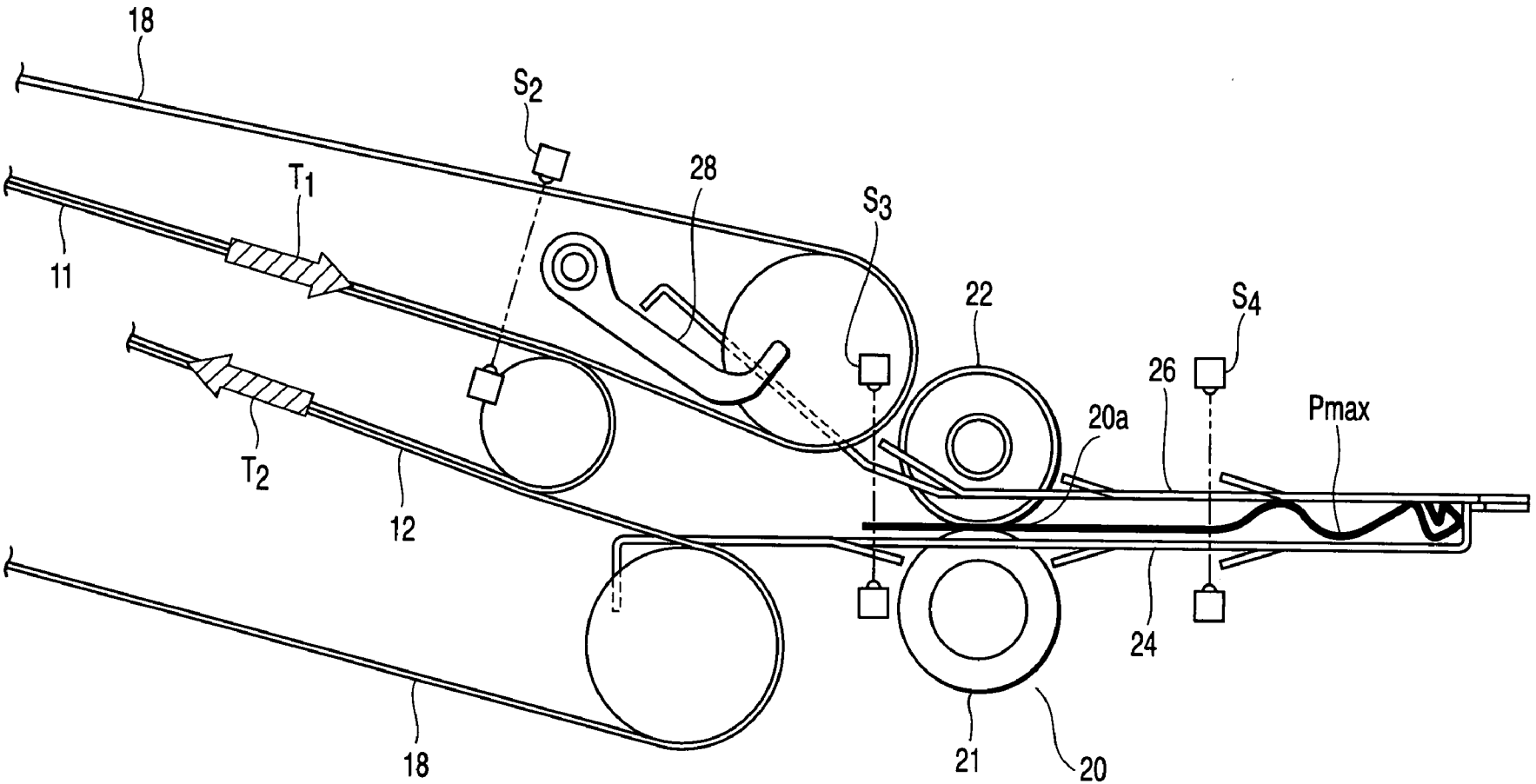
FIG. 10 is a diagram showing a state that the largest paper sheet may assume when it is conveyed again from the state shown in FIG. 8.

Assume that the rear end of paper sheet P2 moving in the first direction after the elimination of a jam has passed the optical axis of the sensor S2 As shown in FIG. 8. Then, it is impossible for the sensor S2 to generate a detection signal for stopping the switchback roller 20 when the conveyance of the paper sheet P2 is resumed to feed it in the first direction. Therefore, if the conveyance continues, the tip of the paper sheet P2 will bump against the stopper 24*a* as shown in FIG. 9 or 10. In the worst case, the tip buckles, causing another jam.

Especially, the tip of the smallest paper sheet Pmin may buckle as described above and as shown in FIG. 9. In this case, the tip of the paper sheet P2 cannot be fed from the switchback section 10 even if the switchback roller 20 is backwardly rotated. This is because the paper sheet P2 is out of the nip 20*a*. Moreover, since the operator cannot see the interior of the switchback section 10 in most cases, the paper sheet P2 cannot be reliably located.

Therefore, the sensor S5 is provided near the stopper 24*a* of the switchback section 10 and can detects that the tip of the paper sheet moving in the first direction and its rear end received in the switchback section 10 can oriented to the second conveyance path 12. This prevents any other jam.

Figure 11:
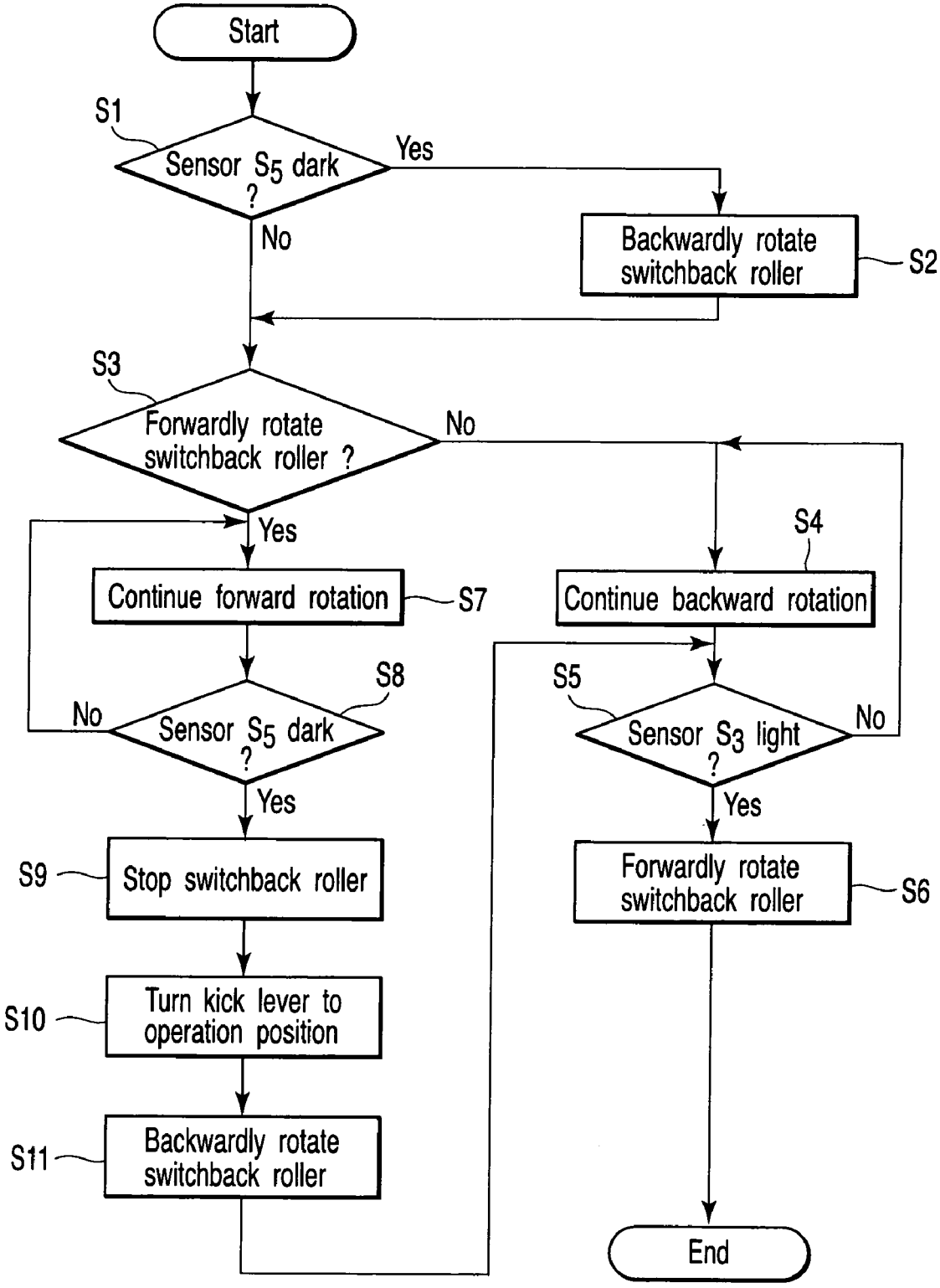
FIG. 11 is a flowchart explaining a method of processing paper sheets, according to an embodiment of this invention.

A return operation is performed in the embodiment of this invention after the jam is eliminated will be described, with reference to the flowchart shown in FIG. 11.

After the jam has been eliminated, the control section 30 determines whether the sensor S5 is dark or not (step 1) before all paper sheets on the conveyance path are conveyed again. If YES in step 1, the control section 30 finds that a paper sheet can be oriented to the second conveyance path 12. The control section 30 immediately rotates the switchback roller 20 backwards, which feeds the paper sheet in the second direction (step 2).

If the sensor S5 is not dark (NO in step 1), the control section 30 determines whether the AC servomotor 31 is rotating forwards to drive the drive roller 21 of the switchback roller 20 (step 3).

If NO in step 3, the control section 30 determines that the paper sheet is being switched back. Then, the section 30 keeps rotating the AC servomotor 31 backwards until the rear end of the paper sheet being switched back, or moving in the second direction, has passed the optical axis of the sensor S3 (steps 4 and 5). If the output of the sensor S3 has become light as a trigger (YES in step 5), the control section 30 drives the switchback roller 20 forwards (step 6). Then, the paper sheet conveyed next is received in the switchback section 10.

If the switchback roller 20 is forwardly rotated (YES in step 3), the control section 30 keeps rotating the switchback roller 20 forwards until the sensor S5 becomes dark (steps 7 and 8). When the output of the sensor S5 has become dark as a trigger (YES in step 8), the control section 30 stops the switchback roller 20 (step 9). The paper sheet detected by the sensor S5 is thereby stopped. At this point, the rear ends of all paper sheets moving along in the first direction can be oriented to the second conveyance path 12 as is illustrated in FIGS. 4 and 5, regardless of their lengths measured in the conveyance direction.

Subsequently, the control section 30 turns the kick lever 28 from the non-operation position to the operation position (step 10). Thus turned, the kick lever 28 orients the rear end of the paper sheet moving in the first direction, to the second conveyance path 12. The control section 30 then drives the switchback roller 20 backwards (step 11).

Then, the process returns to step 5. In step 5, the control section 30 monitors the output of the sensor S3 to determine whether the sensor output has become light (step 5). If YES in step 5, the control section 30 rotates the switchback roller 20 forwards (step 6).

Note that during the return operation described here, the kick lever 28 turned to the operation position in step 10 is not preferably returned to the non-operation position until the tip of the paper sheet moving in the second direction is fed to the second conveyance path 12. That is, if the paper sheet is the smallest one as shown in FIG. 5 and if the kick lever 28 is returned to the non-operation position immediately after it is turned to the operation position, the rear end of the paper sheet moving in the first direction can be oriented back to the first conveyance path 11. This is far from preferable.

As described above, the sensor S5 detects the paper sheet moving in the first direction and received in the switchback section 10, whose rear end along the first direction is located at the position where it can be oriented to the second conveyance path 12. Hence, it is possible to prevent the above-mentioned trouble in the resumption of the conveyance.

As has been explained with FIG. 7, if the rear end of the paper sheet P1 stopped on the way to the switchback section 10 has not passed the sensor S2, the paper sheet P1 conveyed again in the first direction until the sensor S5 detects the tip of the paper sheet P1. When the sensor S5 detects the tip, the paper sheet P1 is stopped and then conveyed in the second direction. Thus, the rear end of the paper sheet P1 along the first direction can be switched back after reaching the position where it can be oriented to the second conveyance path 12. This ensures that the switch pack of the paper sheet P1.

The paper sheet P2 stopped while moving in the first direction, after its rear end thereof has passed the sensor S2 as shown in FIG. 8, may be conveyed again. In this case, the paper sheet P2 is conveyed in the first direction until the sensor S5 detects its tip. When the sensor S5 detects its tip, the paper sheet P2 is stopped and then conveyed backwards, or in the second direction. The paper sheet P2 moving in the first direction can be switched back after its e rear end is at the position where it can be oriented to the second conveyance path 12. This ensures the switchback of the paper sheet P2.

Moreover, this prevents paper sheets from being pushed into the switchback section 10 as illustrated in FIG. 9 or 10, prevents a jam due to the buckling of the paper sheet, and prevents the paper sheet from being out of sight.

In the embodiments described above, the sensor S5 detects the paper sheet fed into the switchback section 10 and having its rear end having reached the position where it can be oriented to the second conveyance path 12. The present invention is not limited to the embodiments, nevertheless. The rear end of the paper moving in the first direction may be detected by, for example, a sensor that can detects the rear end of the paper sheet, which can be oriented to the second conveyance path 12. In addition, the camera 34 may keep photographing the kick lever 28 and anything existing near the lever 28. Thus, the behavior of the rear end of the paper sheet moving in the first direction.

Figure 13:
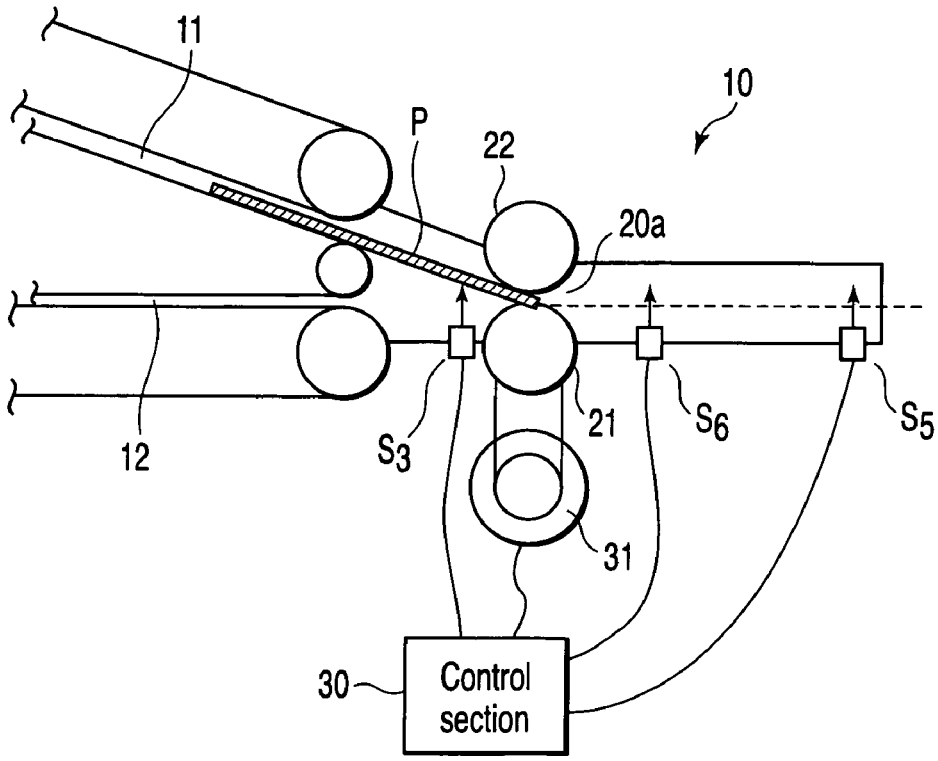
FIG. 13 is a schematic diagram showing the structure of the essential components of a first modification.

A first modification of the return operation after the jam handling in the switchback unit 1 will be explained below, with reference to FIG. 13. FIG. 13 shows the essential components of the switchback unit 1. The components identical to those of the embodiments described above are designated at the same reference numerals and will not be described in detail.

As FIG. 13 shows, a sensor S6 (second sensor) is arranged downstream of the nip 20*a* of the switchback roller 20, with respect to the first direction, in addition to the sensor S3 (third sensor) and the sensor S5 (first sensor). This sensor S6 is spaced away from the sensor S3 by a distance shorter than a dimension that smallest paper sheet Pmin that can be processed has in the conveyance direction.

When the return operation is started after a jam has been eliminated, the control section 30 resumes the conveyance of paper sheet P fed into the switchback section 10, while monitoring the outputs of the sensors S3, S5 and S6. The control section 30 keeps feeding the paper sheet P in a first direction (rightward direction in the drawing) until the sensor S5 detects the tip of the paper sheet P or until the sensor S3 becomes light while the sensor S6 is dark. Then, the control section 30 stops the paper sheet P.

Subsequently, the control section 30 operates the kick lever 28 (not shown), which orients the rear end of the paper sheet P moving in the first direction, to the second conveyance path 12. The control section 30 rotates the drive roller 21 backwards. The paper sheet P is thereby moved to the second conveyance path 12.

Note that the paper sheet P is fed continuously in the second direction when the above-mentioned return operation is started if the sensor S5 has already become dark, if the sensor S3 is light and the sensor S6 is dark, or if the drive roller 21 has already been backwardly rotated.

As described above, the sensor S6 held away from the sensor S3 by a distance shorter than the smallest paper sheet Pmin detects the tip of the paper sheet P in the first modification. Thus, the distance from the nip 20*a* to the sensor S5 need not be determined from the length of the smallest paper sheet Pmin, in contrast to the embodiment described above. The sensor S5 can therefore be located farther away from the nip 20*a*. This increases the tolerance of the length of the paper sheet P that can be processed by this apparatus. Moreover, with the first modification it is no longer necessary to space the nip 20*a* from the entrance the second conveyance path 12 by such a long distance as in the embodiment described above. This enhances the degree of freedom in design.

Figure 14:
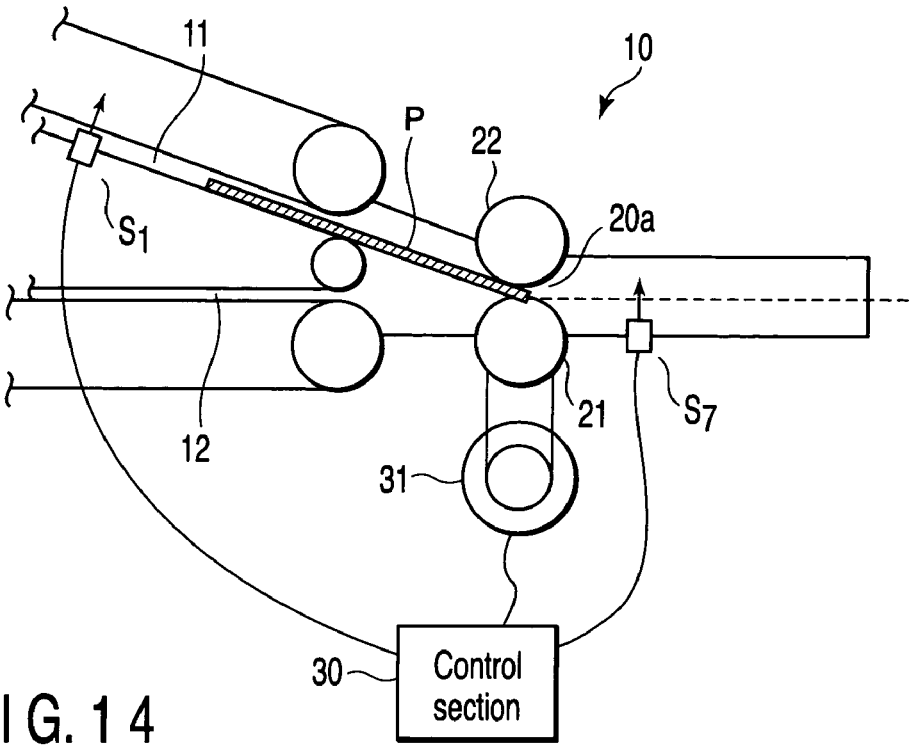
FIG. 14 is a schematic diagram showing the structure of the essential components of a second modification.
Figure 15:
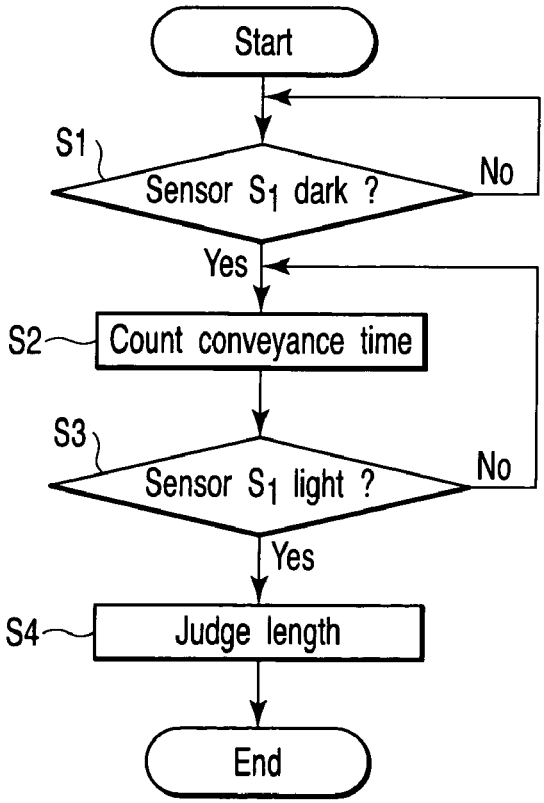
FIG. 15 is a flowchart explaining the operation of detecting the length of the paper sheet.
Figure 16:
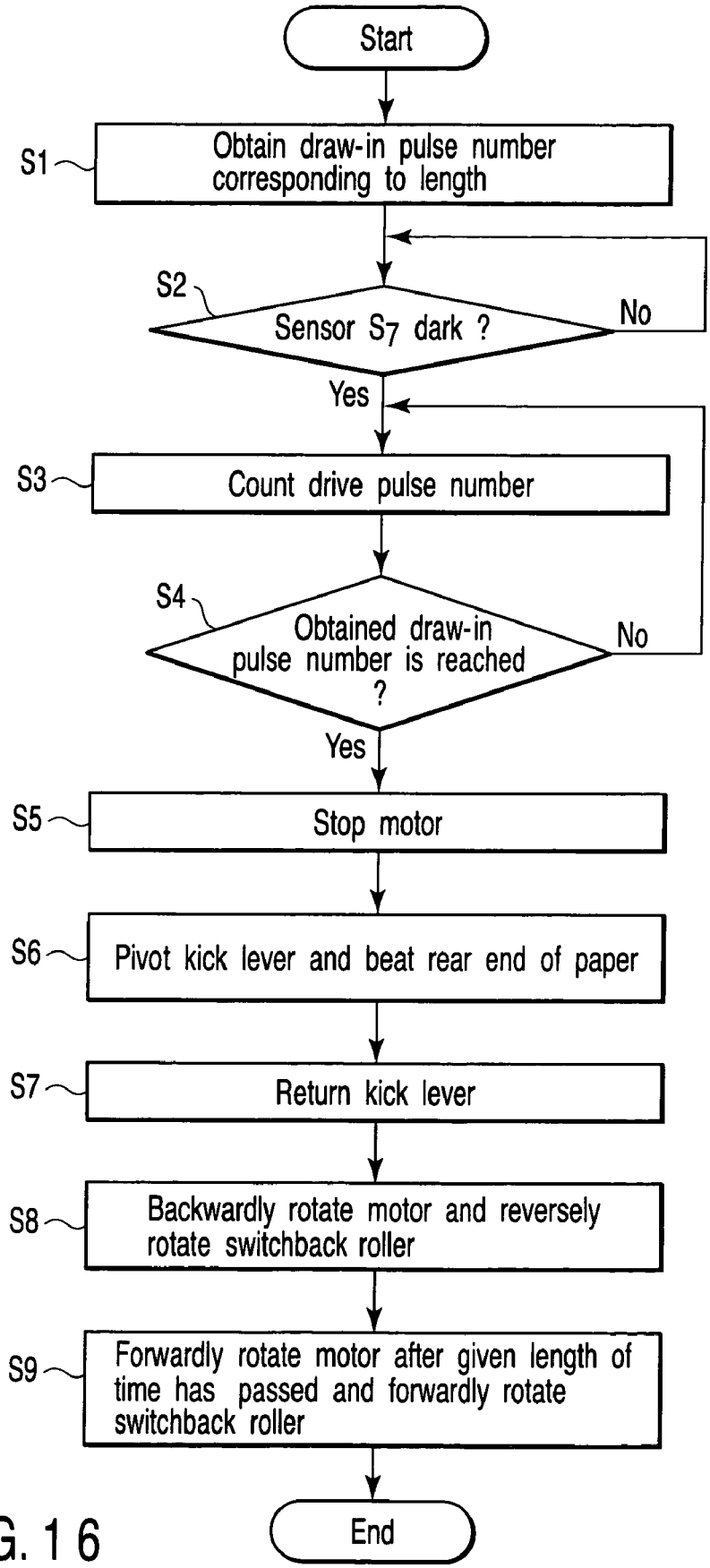
FIG. 16 is a flowchart to explain the operation of the apparatus of FIG. 14.

FIG. 14 schematically shows the essential components of the second modification. In addition to the mentioned sensor S1 (length sensor) that detects the length of the paper sheet as measured in the conveyance direction, a sensor S7 (timing sensor) is provided. The sensor S7 is spaced from the nip 20*a* and located downstream (right side) by a distance shorter than the smallest paper sheet Pmin. Note that FIGS. 15 and 16 are flowcharts that explain a return operation of this modification.

When the return operation is started in this modification, the control section 30 obtains the length of the paper sheet P fed in the conveyance direction into the switchback section 10. The length of the paper sheet P has been detected by, for example, the sensor S1 and is stored in the RAM 37. Alternatively, it may be previously detected, for example, by a shift sensor (not shown) that is arranged upstream of the sensor S1 with respect to the conveyance direction.

The length of the paper sheet P can be determined by using the sensor S1, as described below. First, the time that elapses from the moment the tip of the paper sheet passes the sensor S1 (FIG. 15, step 1; YES) to the moment the rear end of the sheet P passes the sensor S1 (step 3; YES) is measured (step 2). From this time measured and the conveyance speed of the sheet P, the length of the sheet P, as measured in the conveyance direction, is calculated (step 4).

Then, the control section 30 obtains the number of drive pulses for driving the AC servomotor 3, which corresponds to the length of the paper sheet P. The number of drive pulses is the number of draw-in pulses for the switchback roller 20, as shown in step 1 in FIG. 16. The number of draw-in pulses, which corresponds to the length of the paper sheet, is previously prepared in a data table shown in FIG. 17. The data table is stored in the RAM 37. That is, in this modification, the conveyance distance after passing the nip 20*a* is controlled in accordance with the length of the paper sheet, thereby to stop the paper sheet rear end at a specified position. In other words, the number of draw-in pulses for the switchback roller 20 is of such a value that, after the sensor S7 has detected the tip of the paper sheet, the rear end thereof stops at a specific position immediately before the nip 20*a* of the switchback roller 20, no matter how long the sheet is as measured in the conveying direction.

Thus, after obtaining the number of draw-in pulses, corresponding to the length of the paper sheet in step 1, the control section 30 monitors the output of the sensor S7. When the sensor S7 becomes dark, the counter 36 starts counting drive pulses (if YES in step 2, and in step 3). Then, the control section 30 determines whether the number of pulses counted has reached the value obtained in step 1 (step 4). IfYES in step 4, the control section 30 stops the AC servomotor 31, thus stopping the paper sheet (step 5).

Figures 17, 18:
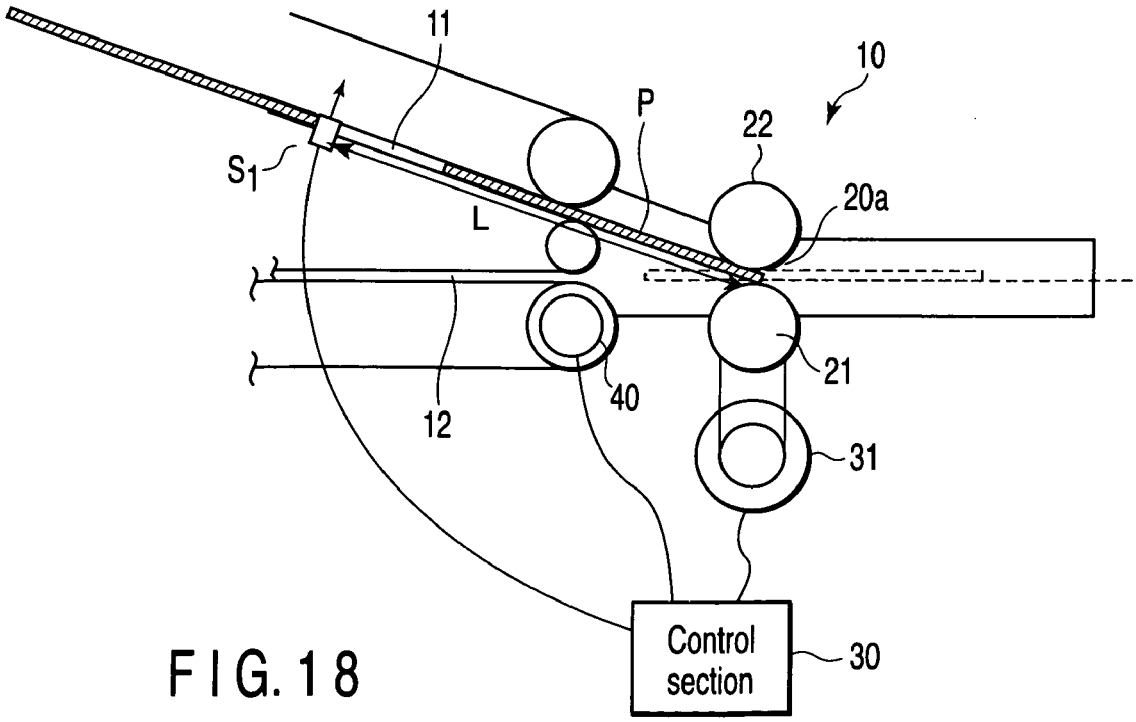
FIG. 17 is a diagram showing a data table stored in a RAM incorporated in the apparatus of FIG. 14.
FIG. 18 is a schematic diagram showing the structure of the essential components of a third modification.

For example, if the paper sheet is the smallest paper one Pmin, being 130 mm long in the conveyance direction, the distance the paper sheet is drawn by the switchback roller 20 is zero as shown in FIG. 17. In this case, the conveyance is stopped the moment the sensor S7 detects the tip of the paper sheet. Moreover, if the paper sheet is 140 mm long, the switchback roller 20 draws the paper sheet into the switchback section 10 for 100 pulses, after the sensor S7 has detected the tip of the paper sheet. The paper sheet is then stopped. In any case, the length at which the rear end of the paper sheet protrudes from the nip 20*a* on the upstream side in the first direction is the same.

After stopping the motor in step 5, the control section 30 makes the rotary solenoid 32 operate the kick lever 28. The kick lever 28 beats the rear end of the paper sheet, orienting it to the second conveyance path 12 (step 6). Then, the control section 30 returns the kick lever 28 to its original position (step 7).

The control section 30 then rotates the servomotor 31 backwards, which rotates the drive roller 21 backwards (step 8). As a result, the drive roller 21 feeds the paper sheet toward the second conveyance path 12. Upon lapse of a given time, the control section 30 again rotates the servomotor 31 forwards, rotating the switchback roller 20 forwards (step 9). Then, the paper sheet conveyed next is received in the switchback section 10.

As described above, the second modification achieves the same advantages as the embodiment described above. The stop position that the paper sheet takes during the switchback can be more accurate. That is, since the paper sheet reaching the switchback roller 20 is conveyed, while being held between the conveyance belts, the conveyance speed may be unstable due to slippage or the like. Nonetheless, the paper sheet is conveyed, while being nipped by the nip 20*a*, when the switchback roller 20 conveys the paper sheet. Hence, the number of pulses that rotates the switchback roller 20 can be monitored, making it possible to determine the conveyance distance correctly. As in the second modification, the number of draw-in pulses for the switchback roller 20 can be set in accordance with the length of the paper sheet in order to stop the paper sheet reliably at the desired position. This helps to accomplish a stable switchback of the paper sheet and to prevent a paper jam.

FIG. 18 schematically shows the essential components of a third modification. In place of the sensor S7 provided downstream of the nip 20*a* (in the second modification), an encoder 40 (speed detection section) is used to monitor the conveyance speed of the paper sheet conveyed on the first conveyance path 11.

In the third modification, the control section 30 detects the tip and rear end of the paper sheet that is passing the sensor S1, thereby to determine the length of the paper sheet as measured in the conveyance direction. At this point, the control section 30 obtains the conveyance speed of the paper sheet from the encoder 40. The control section 30 calculates the length of the paper sheet from the speed and the time the entire sheet has required to pass the sensor Si.

Furthermore, the control section 30 measures the time the paper sheet requires to pass the sensor S1 and reach the nip 20*a*, from the conveyance speed of the paper sheet obtained by the encoder 40 and the distance L between the sensor S1 and the nip 20*a* of the switchback roller 20. Then, the time the tip of the paper sheet in the conveyance direction reaches the nip 20*a* is obtained from the above time. After the paper sheet is nipped by the nip 20*a*, the distance the paper sheet should be drawn is controlled.

As in the second modification described above, the control section 30 obtains the number of draw-in pulses, which corresponds to the length of the paper sheet, from a table (not shown) stored in the RAM 37. Using the number of draw-in pulses, the control section 30 controls the servomotor 31, thus adjusting the stop position of the paper sheet to a constant one, regardless of the length of the paper sheet.

As described above, the third modification achieves the same advantages the embodiment described above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An apparatus for processing paper sheets, comprising:

a switchback roller which has a nip and rotates in a first direction to hold a paper sheet in the nip and then to convey the paper sheet into a switchback section, and rotates in a second direction opposite to the first direction to convey the paper sheet in the second direction, while holding the paper sheet in the nip;

a first conveyance path through which the paper sheet is conveyed in the first direction into the nip of the switchback roller;

a second conveyance path through which the paper sheet is conveyed in the second direction from the nip of the switchback roller;

a sensor which is provided in the switchback section and detects that a rear end of the paper sheet moving in the first direction into the, switchback section has reached a position where the rear end can be oriented to the second conveyance path; and a control section which causes the switchback roller to rotate in the first direction when the sensor does not detect that the rear end of the paper sheet has reached the position and causes the switchback roller to start rotating in the second direction when the sensor detects that the rear end of the paper sheet has reached the position, in order to convey the paper sheet again after having been stopped before reaching the switchback section, wherein the sensor detects a tip of the paper sheet whose rear end has reached the position and, wherein the sensor includes a first sensor that detects a tip of a longest paper sheet that is the longest as measured in the first direction, and a second sensor which is located upstream of the first sensor with respect to the first direction and detects a tip of a shortest paper sheet that is shortest as measured in the first direction, a distance from the nip of the switchback roller to the first sensor is shorter than the longest paper sheet, and a distance from the nip to the second sensor is shorter than the shortest paper sheet.

2. The apparatus according to claim 1, further comprising a third sensor which is provided upstream of the nip with respect to the first direction and spaced away from the second sensor by a distance shorter than the shortest paper sheet and which detects passage of the rear end of the paper sheet moving in the first direction.

3. An apparatus for processing paper sheets, comprising:

a switchback roller which has a nip and rotates in a first direction to hold a paper sheet in the nip and then to convey the paper sheet into a switchback section, and rotates in a second direction opposite to the first direction to convey the paper sheet in the second direction, while holding the paper sheet in the nip;

a first conveyance path through which the paper sheet is conveyed in the first direction into the ni of the switchback roller; a second conveyance path through which the paper sheet is conveyed in the second direction from the nip of the switchback roller;

a sensor which is provided in the switchback section and detects that a rear end of the paper sheet moving in the first direction into the, switchback section has reached a position where the rear end can be oriented to the second conveyance path; and a control section which causes the switchback roller to rotate in the first direction when the sensor does not detect that the rear end of the paper sheet has reached the position and causes the switchback roller to start rotating in the second direction when the sensor detects that the rear end of the paper sheet has reached the position, in order to convey the paper sheet again after having been stopped before reaching the switchback section;

a length sensor which detects a dimension of the paper sheet to be fed into the switchback section in a conveyance direction, and in which the control section conveys the paper sheet in the first direction until the paper sheet is held in the nip, changes the number of drive pulses supplied to the switchback roller, in accordance with the length detected by the length sensor, stops the paper sheet with the rear end located at a specific position immediately before the nip, and rotates the switchback roller in the second direction, in order to convey the paper sheet again after having been stopped before reaching the switchback section; and a timing sensor which detects the tip of the paper sheet at a position downstream of the nip while the paper sheet is being conveyed in the first direction and held in part in the nip, and in which the control section starts counting drive pulse when the timing sensor detects the tip of the paper sheet, and then rotates the switch back roller in the second direction until the rear end of the paper sheet stops at the specific position.

* * * * *